US009079647B2

(12) United States Patent
Curry

(10) Patent No.: US 9,079,647 B2
(45) Date of Patent: Jul. 14, 2015

(54) VENTED PERSONAL FLOTATION DEVICE

(75) Inventor: Philip S. Curry, Black Mountain, NC (US)

(73) Assignee: Astral Buoyancy Company, LLC, Asheville, NC (US)

( * ) Notice: Subject to any disclaimer, the term of this patent is extended or adjusted under 35 U.S.C. 154(b) by 533 days.

(21) Appl. No.: 12/101,210

(22) Filed: Apr. 11, 2008

(65) Prior Publication Data

US 2008/0188149 A1 Aug. 7, 2008

Related U.S. Application Data

(63) Continuation-in-part of application No. 11/891,327, filed on Aug. 8, 2007, now abandoned.

(60) Provisional application No. 60/836,619, filed on Aug. 8, 2006.

(51) Int. Cl.

| | |
|---|---|
| ***B63C 9/08*** | (2006.01) |
| ***B63C 9/115*** | (2006.01) |
| ***B63C 9/125*** | (2006.01) |

(52) U.S. Cl.

CPC ..... *B63C 9/115* (2013.01); *B63C 9/1255* (2013.01)

(58) Field of Classification Search

CPC ..... A41D 13/0158; B63C 9/115
USPC ..... 441/80, 88, 102–119
See application file for complete search history.

(56) References Cited

U.S. PATENT DOCUMENTS

| | | | | |
|---|---|---|---|---|
| 2,629,118 | A * | 2/1953 | Frieder etal. | 441/110 |
| 4,242,769 | A * | 1/1981 | Rayfield et al. | 441/91 |
| 4,739,522 | A * | 4/1988 | Lassiter et al. | 441/102 |
| 4,787,219 | A | 11/1988 | Sato et al. | |
| 4,799,908 | A | 1/1989 | Lucius | |
| 5,385,036 | A | 1/1995 | Spillane et al. | |
| 5,896,758 | A | 4/1999 | Rock et al. | |
| 6,029,270 | A | 2/2000 | Ost et al. | |
| 6,186,185 | B1 | 2/2001 | Khokar | |
| 6,363,527 | B1 | 4/2002 | Biermann et al. | |
| 6,477,865 | B1 | 11/2002 | Matsumoto | |
| 6,489,000 | B1 | 12/2002 | Ogura et al. | |
| 6,547,614 | B2 | 4/2003 | Wagner | |
| 6,986,691 | B2 | 1/2006 | Johnson et al. | |
| 7,060,156 | B2 * | 6/2006 | Mack et al. | 156/285 |
| 2005/0010987 | A1 * | 1/2005 | Crye et al. | 2/2.5 |
| 2009/0112138 | A1 * | 4/2009 | Evans et al. | 602/6 |

* cited by examiner

*Primary Examiner* — Edwin Swinehart
(74) *Attorney, Agent, or Firm* — Luedeka Neely Group, P.C.

(57) ABSTRACT

Personal flotation devices (PFD's), also known as life jackets, swim vests, etc., including various structures which promote an increased flow of air within the PFD thereby conveying warm, moisture laden air away from the wearer, and allowing at least some ambient air to reach the skin or outer clothing of the wearer. Either or both of at least two modes are provided for fluid passage or "venting." One fluid passage mode is in directions parallel to an inner side (i.e. "lateral"), with fluid passages being defined by structures such as projections or within various three-dimensional permeable materials, such as spacer fabric. Another fluid passage mode is through an aperture in a buoyant intermediate layer. Depending upon the particular design, a blend or combination of these two modes is achieved.

9 Claims, 10 Drawing Sheets

VENTED PERSONAL FLOTATION DEVICE

CROSS-REFERENCE TO RELATED APPLICATIONS

This is a continuation-in-part of U.S. patent application Ser. No. 11/891,327, filed Aug. 8, 2007, the entire disclosure of which is hereby expressly incorporated by reference, and which in turn claims the benefit of U.S. Provisional Patent Application Ser. No. 60/836,619, filed Aug. 8, 2006.

BACKGROUND OF THE INVENTION

The invention relates generally to personal flotation devices (PFD's), also known as life jackets, swim vests, etc. The invention more particularly relates to PFD's which are worn while boating, particularly paddle sports, during which the wearer is exerting.

SUMMARY OF THE INVENTION

In one aspect, a personal flotation device is provided. The personal flotation device includes an outer layer, a permeable inner layer, and a buoyant intermediate layer including a buoyant material between the outer layer and the permeable inner layer. At least one aperture passes through the buoyant intermediate layer, to allow fluid passage, and the outer layer is permeable at least where the aperture terminates.

In another aspect, a personal flotation device is provided. The personal flotation device includes an outer layer, a permeable inner layer, and a buoyant intermediate layer including a buoyant material between the outer layer and the permeable inner layer. The buoyant intermediate layer has an inner side facing towards the permeable inner layer. A plurality of projections on the inner side of the buoyant intermediate layer serve as spacers from the permeable inner layer so as to define passages for fluid passage at least in directions generally parallel to the inner side.

In yet another aspect, a personal flotation device is provided. The personal flotation device includes an outer layer and an inner layer of three-dimensional knit spacer fabric of the type including spaced-apart inner and outer permeable fabric sublayers interconnected by resilient pile, the resilient pile defining passages for fluid passage at least in directions generally parallel to the inner layer. There is at least one buoyant intermediate layer including a buoyant material between the outer layer and the inner layer.

In still another aspect, a personal flotation device is provided. The personal flotation device includes an outer layer, a buoyant intermediate layer made of a buoyant material, a permeable intermediate layer made of a permeable three-dimensional material, and a permeable inner layer.

DETAILED DESCRIPTION

Figure 1:
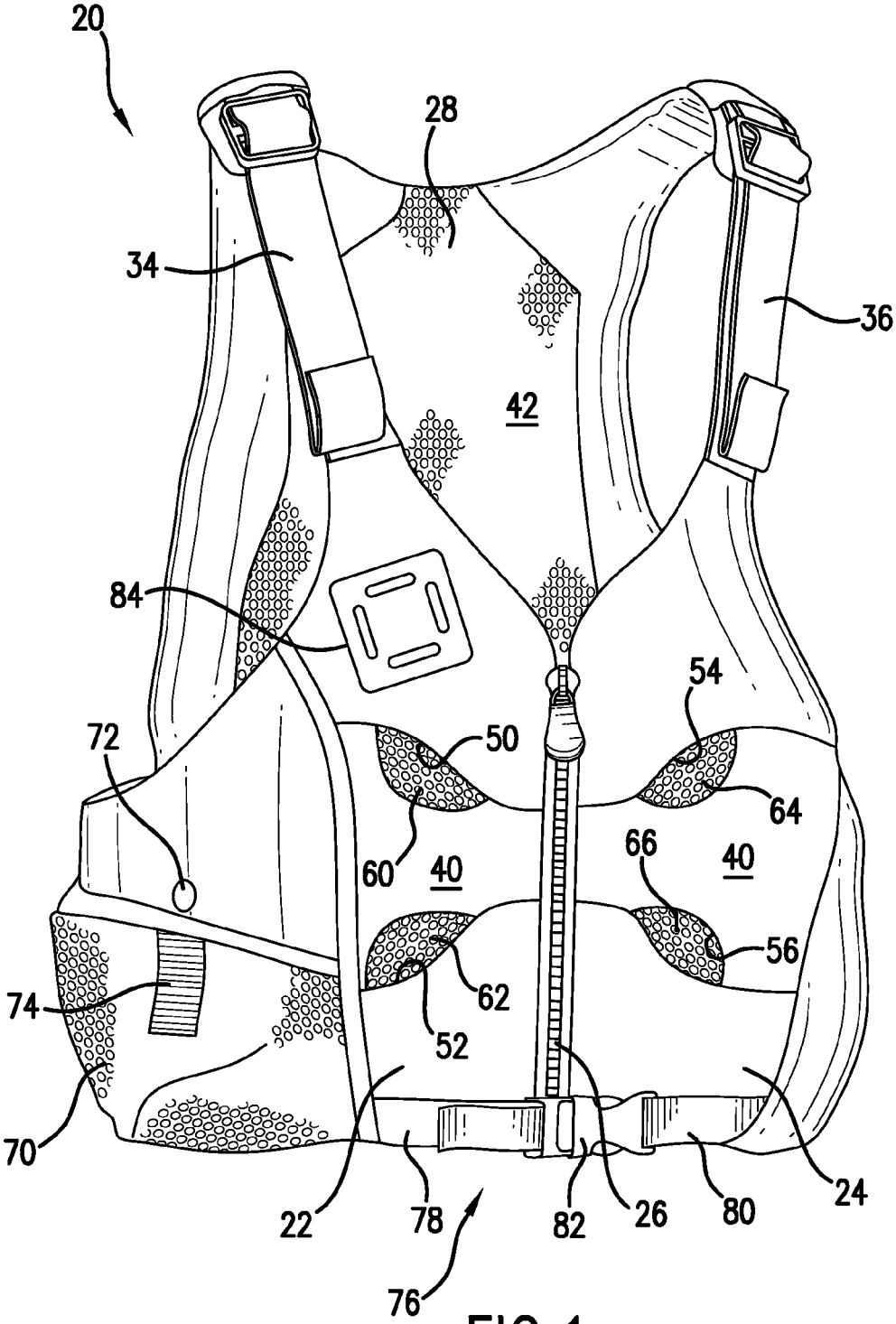
FIG. 1 is a three-dimensional view from the front of a personal flotation device embodying the invention.

Referring first to FIG. 1, a vented personal flotation device (PFD) 20 embodying the invention includes right and left functional (i.e., serving at least to provide buoyancy) front panels 22 and 24 interconnected by a zipper 26, and a functional rear panel 28. In the particular embodiment illustrated in FIG. 1, the front panels 22 and 24 are connected to the rear panel 28 by adjustable side webbing (not visible). A pair of adjustable shoulder straps 34 and 36 interconnect the upper portion of the rear panel 28 with the upper portions of the front panels 22 and 24.

The personal flotation device 20 is referred to as a "vented" personal flotation device because the panels 22, 24 and 28 include various structures, described in detail hereinbelow, which promote an increased flow of air within the PFD 20 thereby conveying warm, moisture-laden air away from the wearer (not shown). In addition, some ambient air is allowed to reach the skin or outer clothing of the wearer. The wearer accordingly is enabled to maintain a more comfortable body temperature and moisture level, that is, to remain cooler, particularly when exerting during paddle sports, as an example.

The individual panels 22, 24 and 28 may be constructed in a variety of ways, exemplified by various more particular embodiments of the invention described hereinbelow with reference to FIGS. 2-10. Although the illustrated personal flotation device 20 includes separate panels 22, 24 and 28, the invention may as well be embodied in a personal flotation device (not shown) which in essence includes a unitary wrap-around panel with all portions thereof providing buoyancy. FIG. 1 thus illustrates just one particular overall configuration of a personal flotation device embodying the invention, by way of example and not limitation.

Visible in FIG. 1 is a panel outer layer 40 made of a durable and abrasion- and rip-resistant material, such as 200 denier rip stop nylon. Depending upon the particular embodiment, the outer layer 40 may or may not be permeable, a characteristic which is sometimes referred to as "breathable." As employed herein, the term "permeable" means that air and moisture are able to pass through, as part of the venting function.

The particular PFD 20 embodiment represented in FIG. 1 also includes a permeable inner layer 42 in a representative form of a plastic mesh such as a large-void polyester mesh. During use, the permeable inner layer 42 contacts either the wearer's skin, or the wearer's outermost clothing. A typical polyester mesh is knitted to provide openings 2 mm to 6 mm in diameter spaced 1 mm to 7 mm apart.

The particular PFD 20 illustrated in FIG. 1 also includes a plurality of venting apertures 50, 52, 54 and 56 as part of the right and left front panels 22 and 24. The venting apertures 50, 52, 54 and 56, for appearance design purposes, are in the general shape of cat eyes, and terminate in respective mesh covers 60, 62, 64 and 66 which are made of the same large-void polyester mesh material of which the permeable inner layer 42 is made. Thus, the mesh covers 60, 62, 64 and 66 interrupt and are sewn to the fabric of the outer layer 40 at the locations of the venting apertures 50, 52, 54 and 56. An exemplary one of the venting apertures 50, 52, 54 and 56 is described in greater detail hereinbelow with reference to FIG. 5.

The particular PFD 20 illustrated additionally includes a mesh side pocket 70 secured by a snap 72, as well as a pull tab 74. A lower adjustment strap 76 includes a pair of segments 78 and 80 connected by a buckle 82. A plastic tab 84 for attachment of accessories commonly used by wearers of PFDs, such as a whistle, nose-plugs, or a sheathed rescue knife, is provided on the right front panel 22.

As noted above, the individual panels 22, 24 and 28 may be constructed in a variety of ways, exemplified by various more particular embodiments described next below.

Figure 2:
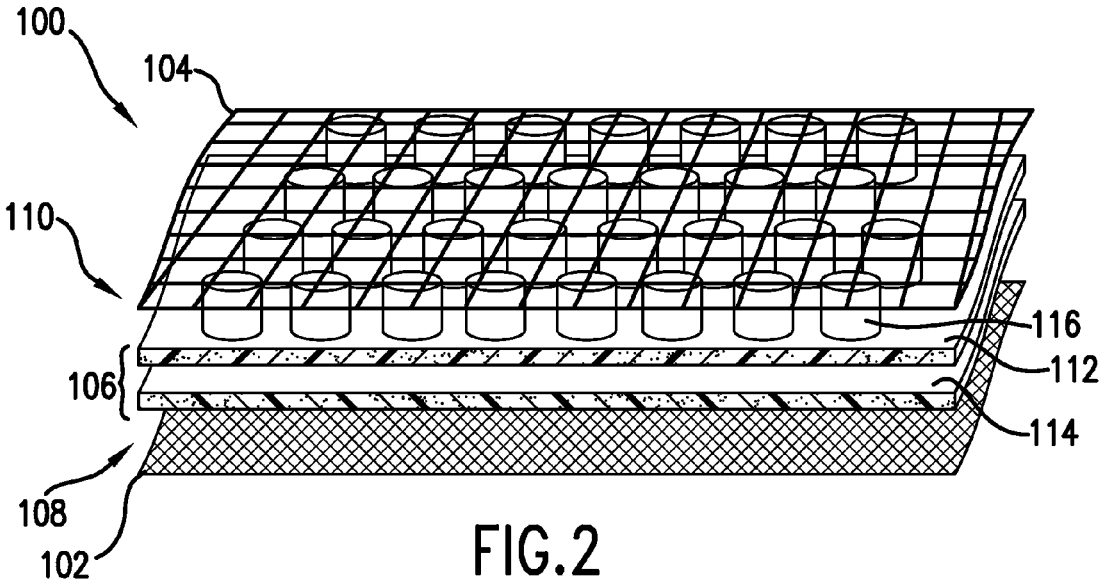
FIG. 2 is a partially exploded representation of a portion of the body of a personal flotation device representing an embodiment of the invention.

Thus, with reference to FIG. 2, the FIG. 1 panels 22, 24 and 28 may be embodied as a panel portion 100. The panel portion 100 includes an outer layer 102 corresponding to the FIG. 1 outer layer 40, in the form of a durable, abrasion- and rip-resistant material, such as 200 denier rip stop nylon. The panel portion 100 additionally includes a permeable inner layer 104, corresponding to the permeable inner layer 42 of FIG. 1. The permeable inner layer 104 is somewhat schematically represented in FIG. 2, and may take the form of plastic mesh such as large-void polyester mesh.

Between the outer layer 102 and the permeable inner layer 104 is a buoyant intermediate layer 106 having an outer side 108 facing towards the outer layer 102 and an inner side 110 facing towards the permeable inner layer 104. In the illustrated embodiment, the buoyant intermediate layer 106 is made of a plurality of sublayers. Although the buoyant intermediate layer 106 may be of multiple-layer construction, with more than just two sublayers, in the illustrated embodiment there are two sublayers 112 and 114. (As other examples, the buoyant intermediate layer 106 may be made of eight sublayers of closed-cell foam, each ⅛ inch in thickness, or the buoyant intermediate layer 106 may be made of a single layer of closed-cell foam one inch in thickness.) The sublayers 112 and 114 may be adhered to each other as a structure, or the sublayers 112 and 114 may simply be sandwiched together. Alternatively, and as stated parenthetically just above, the buoyant intermediate layer 106 may be unitary (not shown), not including sublayers.

The buoyant intermediate layer 106 may be shaped to accommodate the torso contours of the type of wearer expected to use the PFD 20. For example, PFDs intended for male adults, female adults and children have differently shaped buoyant intermediate layers 106.

The FIG. 2 sublayer 112 is embossed with a plurality of projections 116, described in greater detail hereinbelow with reference to FIGS. 3, 3A and 4, and may be referred to as a spacing sublayer 112 in view of a spacing function provided by the projections 116. Thus the projections 116 define passages for fluid (e.g. air and moisture) passage at least in directions generally parallel to the inner side 110 (which may be viewed as "lateral" venting air flow). Direct contact of the projections 116 with the skin or clothing of the wearer is in general avoided by the permeable inner layer 104 (although some of the projections 116 may at least in part protrude through voids in the polyester mesh material of the inner layer 104). This general avoidance of direct contact of the projections 116 with the skin of the wearer, in combination with the presence of the inner layer 104 itself, minimizes any tendency of the spacing sublayer 112 and projections 116 to "stick" to the skin of the wearer, promotes air flow, and generally aids comfort.

The spacing sublayer 112 is made of ethylene vinyl acetate (EVA) closed-cell molded foam. Alternatively, the spacing sublayer 112 may be made of another thermoformable closed-cell plastic foam. Polyethylene foam is an example.

It is at least the sublayer 114 which imparts buoyancy to the overall buoyant intermediate layer 106, although in the illustrated embodiment the spacing sublayer 112 is buoyant as well. The sublayer 114 is made of any buoyant material, such as high buoyancy closed-cell foam. Alternatively, the sublayer 114, rather than closed-cell foam, may comprise one or more inflatable air bladders, or fibrous buoyant material (such as kapok) encased in a polymeric envelope, as examples.

Figure 3:
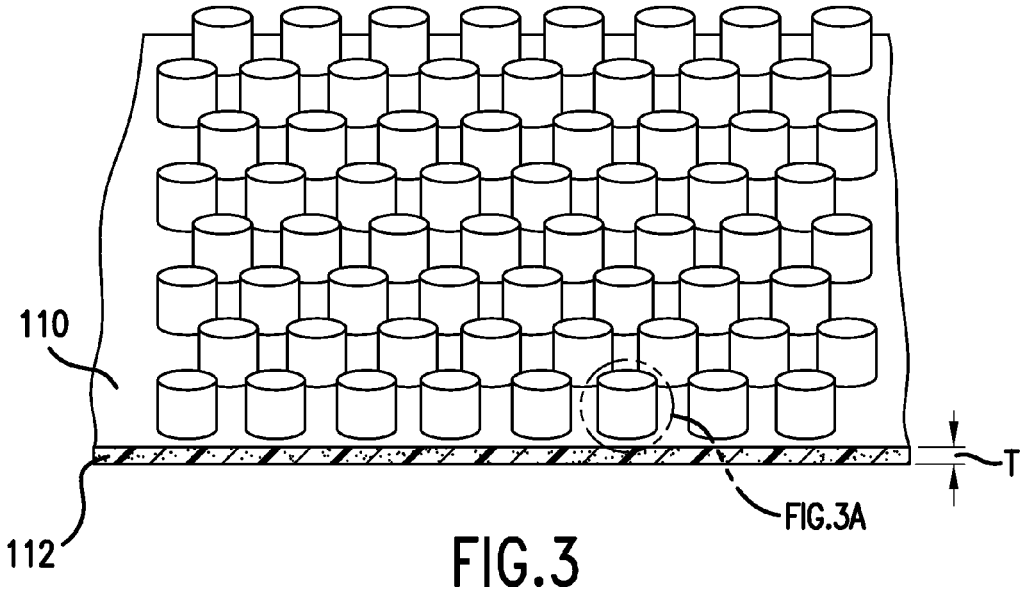
FIG. 3 is a view, in isolation, of one of the layers of the FIG. 2 representation.
Figure 3A:
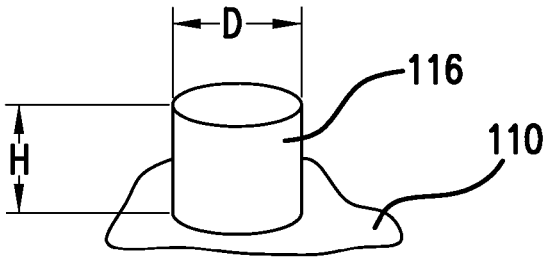
FIG. 3A is an enlarged detail view of a portion of FIG. 3.
Figure 4:
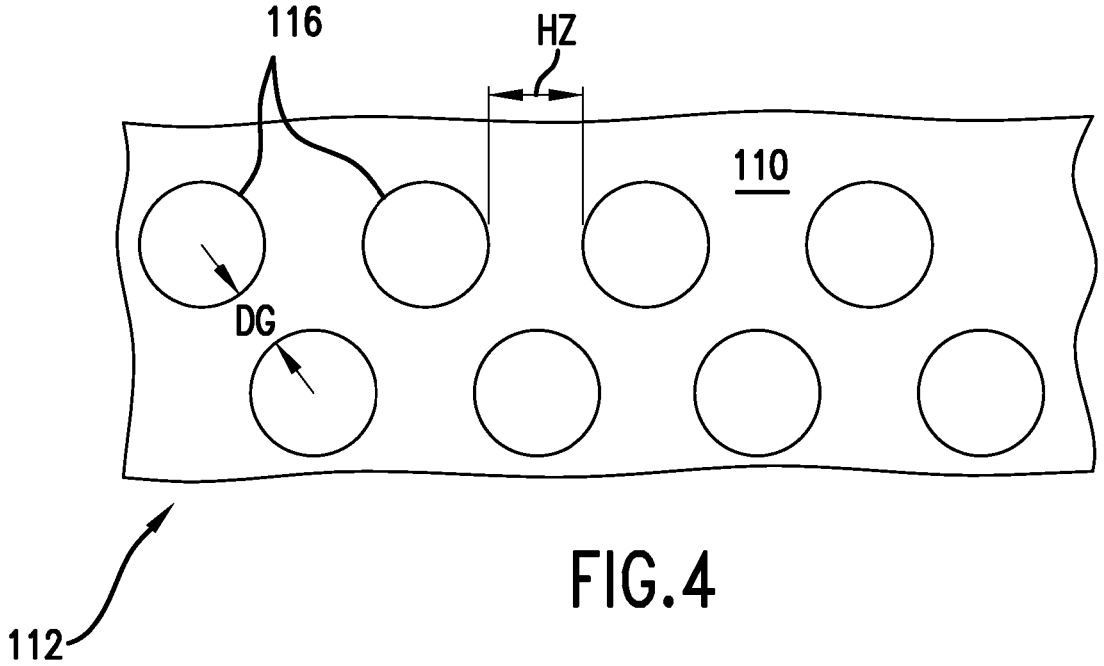
FIG. 4 is a fragmentary top plan view of the FIG. 3 layer.

With particular reference to FIGS. 3, 3A and FIG. 4, the spacing sublayer 112 is shown in isolation and in greater detail. The inner side 110 of the buoyant intermediate layer 106 corresponds to the side 110 of the spacing sublayer 112 visible in FIGS. 3, 3A and 4. Exclusive of the projections 116, the spacing sublayer 112 has a thickness "T" of approximately 2 mm.

A plurality of the projections 116 are provided on the inner side 110 of the spacing sublayer 112 and thus of the buoyant intermediate layer 106, and serve as spacers from the permeable inner layer 104 (corresponding to the FIG. 1 layer 42) (and thus from the skin or clothing of the wearer) so as to define passages for fluid passage at least in directions generally parallel to the inner side 110. Accordingly, "venting" is provided whereby moist, heated air is able to flow along and away from the body of the wearer. In addition, ambient air is allowed to flow towards and along the skin or outer clothing of the wearer, to some degree. As a result, the wearer is enabled to remain cooler and more comfortable.

In FIGS. 2-4, the projections 116 are cylindrical projections 116, each of which has a height "H" (FIG. 3A) of approximately 7 mm and a diameter "D" (FIG. 3A) of approximately 7.5 mm. With reference to FIG. 4, the projections 116 are spaced apart on the horizontal "HZ" approximately 12.5 mm and on the diagonal "DG" by approximately 6 mm. These dimensions are exemplary only; the size and spacing of the projections 116 may vary.

As will be apparent from the description of further embodiments hereinbelow with reference to FIGS. 5-10, the structure represented in FIG. 2 may be modified in a variety of ways.

The projections 116 may be unitary with the spacing sublayer 112 and thus unitary with the buoyant intermediate layer 106, or they may be adhered. The projections 116 can alternatively be square, rectangular, triangular, or otherwise polygonal, or some combination thereof. The size and spacing of the projections 116 may vary. The projections 116 may also be separately incorporated into the PFD instead of being molded or convoluted with the spacing sublayer 112 or buoyant intermediate layer 106 as a unitary layer. The projections 116 may be convoluted foam projections, as is described hereinbelow in the particular context of the embodiment of FIG. 5.

Fluid passage (i.e. "venting" air flow) may be entirely in directions parallel to the inner side 110 (i.e. "lateral") to exit at the edges of the FIG. 1 panels 22, 24 and 28, or may be wholly or in part through the buoyant intermediate layer 106, either via a small number of relatively large apertures as described hereinbelow with particular reference to FIG. 5, or via a multiplicity of much smaller apertures, as is described hereinbelow with particular reference to FIG. 6. Various combinations of fluid passage modes may be provided depending on particular design details. Although fluid passage or "venting" is described herein primarily in the context of conducting warm, moisture-laden air away from the wearer, the fluid passage or "venting" correspondingly includes allowing ambient air to reach the skin or outer clothing of the wearer, at least to some degree.

Figure 5:
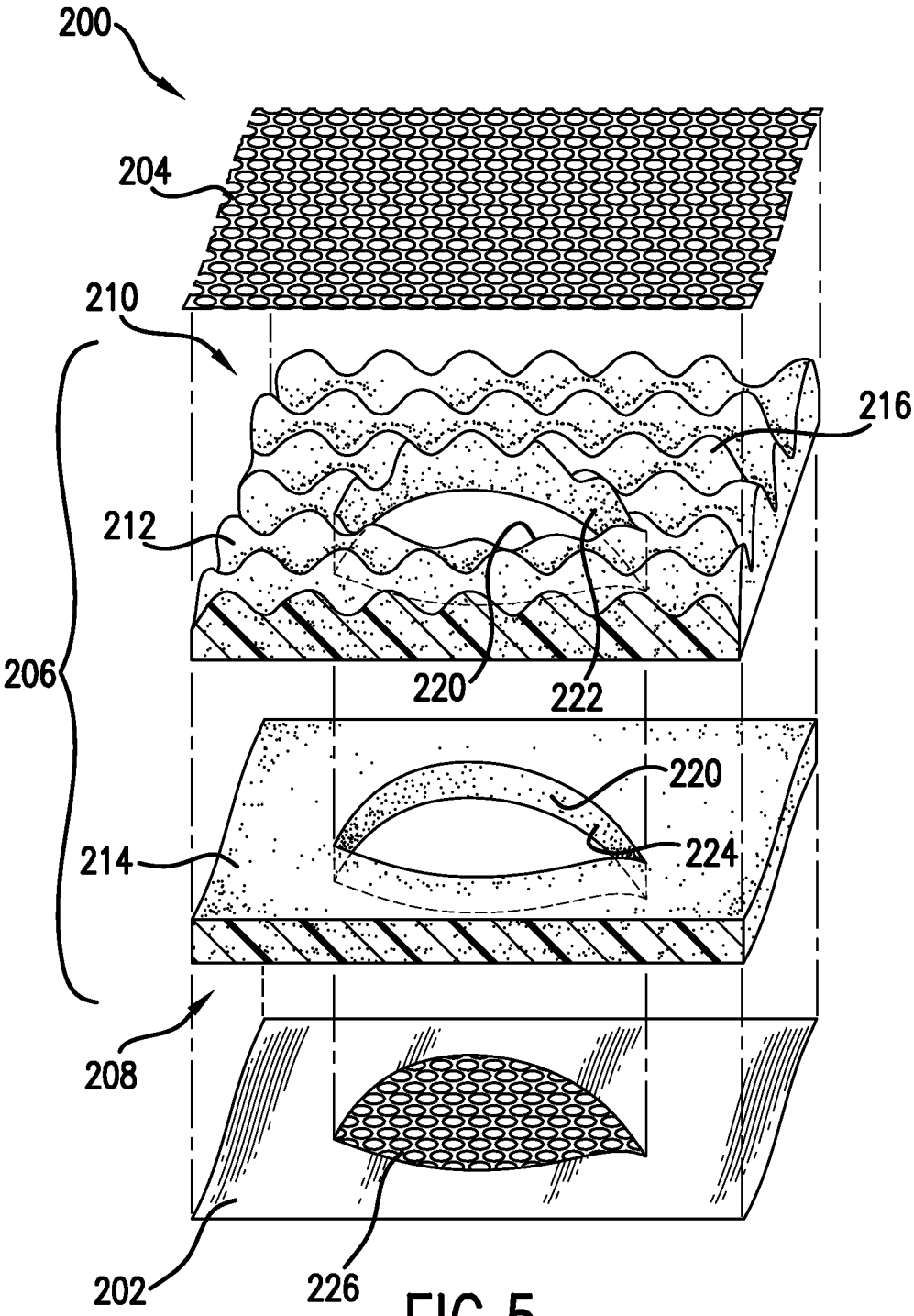
FIG. 5 is an exploded view of a portion of a personal flotation device representing another embodiment of the invention.

FIG. 5 is an exploded view of a panel portion 200 representing another embodiment of the invention. Thus, the FIG. 1 panels 22, 24 and 28 may be embodied as the FIG. 5 panel portion 200. The panel portion 200 includes an outer layer 202 corresponding to the FIG. 1 outer layer 40, in the form of a durable, abrasion- and rip-resistant material, such as 200 denier rip stop nylon. The panel portion 200 additionally includes a permeable inner layer 204, corresponding to the permeable inner layer 42 of FIG. 1, and taking the form of plastic mesh such as large-void polyester mesh.

Between the outer layer 202 and the permeable inner layer 204 is a buoyant intermediate layer 206. The buoyant intermediate layer 206 has an outer side 208 facing towards the outer layer 202 and an inner side 210 facing towards the permeable inner layer 204. As in the case of the buoyant intermediate layer 106 in the panel portion 100 of FIG. 2, in the panel portion 200 of FIG. 5 the buoyant intermediate layer 206 is made of a plurality of sublayers. Again, although the buoyant intermediate layer 206 may be of multiple-layer construction, with more than just two sublayers. In FIG. 5 there are two sublayers, a spacing sublayer 212 and another sublayer 214 made of any buoyant material. Again, it is at least the sublayer 214 which imparts buoyancy to the overall intermediate layer 206, although in the illustrated embodiment the spacing sublayer 212 is buoyant as well. The sublayers 212 and 214 may be made of the same materials as the sublayers 112 and 114 described hereinabove with reference to the embodiments of FIGS. 2-4. As described above, the sublayers 212 and 214 may be adhered to each other as a structure, or the sublayers 212 and 214 may simply be sandwiched together. Alternatively, the buoyant intermediate layer 206 may be unitary (not shown), not including sublayers.

The panel portion 200 embodiment of FIG. 5 differs from the panel portion 100 embodiment of FIG. 2 in at least three respects. First, the sublayer 214 is illustrated as convoluted foam, and includes projections 216 in the form of convoluted foam projections 216, which resemble rounded waves, somewhat sinusoidal in cross section. By way of example, the convoluted foam projections 216 have a density of 1550 peaks per square meter, and a valley-to-peak height within the range of 4 mm to 6 mm. Since the spacing sublayer 212 is a sublayer of the buoyant intermediate layer 206, the convoluted foam projections 216 are also part of the buoyant intermediate layer 216 and extend from the inner side 210 of the buoyant intermediate layer. In the case of a unitary buoyant intermediate layer 206 (not shown), the unitary buoyant intermediate layer would have a convoluted inner side 210.

The convoluted foam projections 216 function in a manner essentially identical to that of the projections 116 described above with reference to FIGS. 2-4, providing a spacing function. Thus, the convoluted foam projections serve as spacers from the permeable inner layer 204 (corresponding to the FIG. 1 layer 42) (and thus serve as spacers from the skin or clothing of the wearer) so as to define passages for fluid (e.g. air and moisture) passage at least in directions generally parallel to the inner side 210 (which, again, may be viewed as "lateral" venting air flow).

The second respect in which the panel portion 200 embodiment of FIG. 5 differs from the panel portion 100 embodiment of FIG. 2 is that an aperture 220 is provided in the buoyant intermediate layer 206 to allow fluid (e.g. air and moisture) passage. The aperture 220 corresponds to any one of the venting apertures 50, 52, 54 or 56 described hereinabove with reference to FIG. 1, and has typical dimensions of 60 mm×30 mm. The overall aperture 220 has two portions, an aperture portion 222 through the spacing sublayer 212, and an aperture portion 224 through the sublayer 224.

The third respect in which the panel portion 200 embodiment of FIG. 5 differs from the panel portion 100 embodiment of FIG. 2 is that the outer layer 202 is necessarily permeable at least where the aperture 220 terminates. Although the material of the outer layer 202 itself may be generally permeable, to ensure maximum permeability for "venting," a mesh cover 226 interrupts and is sewn to the fabric of the outer layer 202. The mesh cover 226 of FIG. 5 corresponds to any one of the mesh covers 60, 62, 64 or 66 of FIG. 1. The mesh cover 226 is made of the same material as the permeable inner layer, such as polyester mesh having voids approximately 4 mm in diameter and spaced 5 mm center-to-center. Thus, relatively unimpeded passage of venting air flow is provided through the aperture 220.

Accordingly, in the FIG. 5 embodiment, at least two modes are provided for fluid passage or "venting." Again, such fluid passage or "venting" includes allowing warm moisture-laden air to escape from the wearer during use, as well as allowing ambient air to reach the wearer, at least to some degree.

One fluid passage mode is in directions parallel to the inner side 210, aided somewhat by the permeable inner layer 204 and more particularly by the convoluted foam projections 216 which define passages for fluid passage. The second fluid passage mode is through the buoyant intermediate layer 206, that is, through the aperture 220 in the buoyant intermediate layer 206, in combination with the mesh cover 226 serving as a permeable portion of the outer layer 202. Depending upon the particular design of the panel portion 200 embodying any one of the FIG. 1 panels 22, 24 and 28, a blend or combination of these two modes is achieved. Thus, considering air flow in directions parallel to the inner side 210 (i.e. "lateral") as a starting point, such air flow may terminate (or begin) either at the edges of the FIG. 1 panels 22, 24 and 28, or at the aperture 220.

Figure 6:
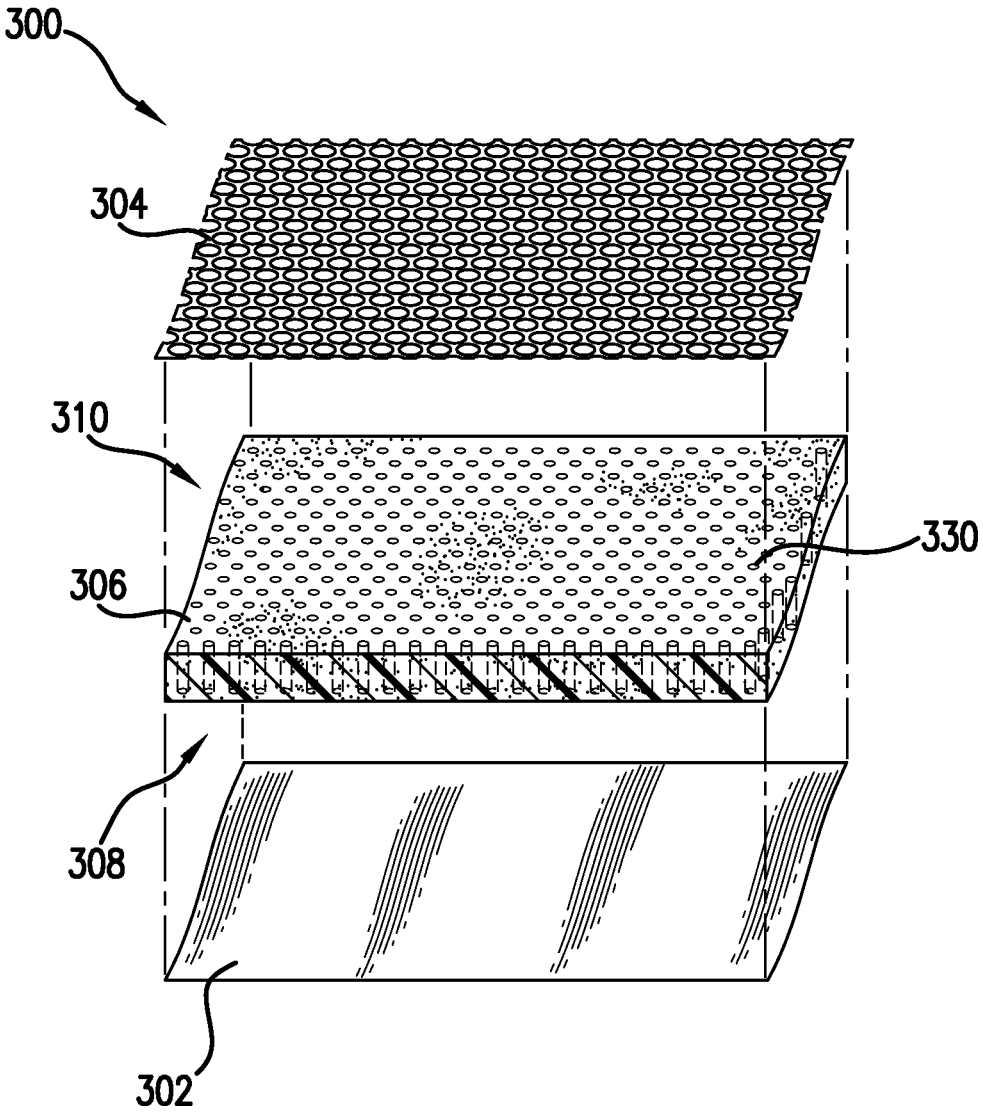
FIG. 6 is an exploded three-dimensional view of a portion of a personal flotation device representing yet another embodiment of the invention.

FIG. 6 is an exploded view of a panel portion 300 representing another yet embodiment of the invention. Thus, the FIG. 1 panels 22, 24 and 28 may be embodied as the FIG. 6 panel portion 300. The panel portion 300 includes a permeable outer layer 302 corresponding to the FIG. 1 outer layer 40, in the form of a durable, abrasion- and rip-resistant material, such as 200 denier rip stop nylon. The panel portion 300 additionally includes a permeable inner layer 304, corresponding to the permeable inner layer 42 of FIG. 1, and taking the form of plastic mesh such as large-void polyester mesh.

Between the outer layer 302 and the permeable inner layer 304 is a buoyant intermediate layer 306. The buoyant intermediate layer 306 has an outer side 308 facing towards the outer layer 302 and an inner side 310 facing towards the permeable inner layer 304. In FIG. 6, the buoyant intermediate layer 306 is unitary, not including sublayers as in the panel portions 100 and 200 of FIGS. 2 and 5. However, the buoyant intermediate layer 306 may as well include sublayers.

The panel portion 300 embodiment of FIG. 6 differs from the panel portion 200 embodiment of FIG. 5 in that, rather than a relatively small number (e.g. four) of relatively large apertures, a relatively larger number of apertures 330, in other words, a multiplicity of apertures 330, are provided in and extending through the buoyant intermediate layer 306. By way of example, the apertures 330 may each have a diameter within the range of 1 mm to 7 mm, with a density of 3 to 20 apertures per square centimeter. Suitable materials for the apertured buoyant intermediate layer 306 include closed-cell foam materials such as polyethylene, NBR, PVC, neoprene, and EVA.

In FIG. 6, the outer layer 302 is permeable at least where the apertures 330 terminate. As a practical matter, the outer layer 302 is uniformly permeable. An example of a suitable material is uncoated 240 denier nylon.

In the FIG. 6 embodiment, essentially only one mode is provided for fluid passage or "venting." In particular, the fluid passage mode is through the apertures 330 and through the permeable outer layer 302. Any air flow in directions generally parallel to the inner side 310 (i.e. "lateral") is incidental.

Accordingly, it will be appreciated that FIG. 2 and FIG. 6 represent extremes of the two fluid passage modes described herein. In FIG. 2 the fluid passage mode is in directions generally parallel to the inner side 110, which might also be referred to as "lateral," without venting air flow through the buoyant intermediate layer 106. In FIG. 6, substantially all of the venting air flow is through the buoyant intermediate layer 306, with substantially no "lateral" venting air flow in directions generally parallel to the inner side 310.

As described hereinabove with reference to the FIG. 5 panel portion 200, structures may be provided wherein a blend or combination of these two modes is achieved, between the two extremes. FIG. 5 is one such structure, albeit employing a relatively large aperture 220, rather than a multiplicity of apertures 330. A modification (not shown) of the panel portion 300 of FIG. 6 includes a plurality of projections on the buoyant intermediate layer 306 to provide a spacing function, as described hereinabove with reference to the embodiments of FIG. 2 and FIG. 5. As a more particular example, the buoyant intermediate layer 306 may be made of closed-cell convoluted foam, and also having the plurality of apertures 330.

Figure 7:
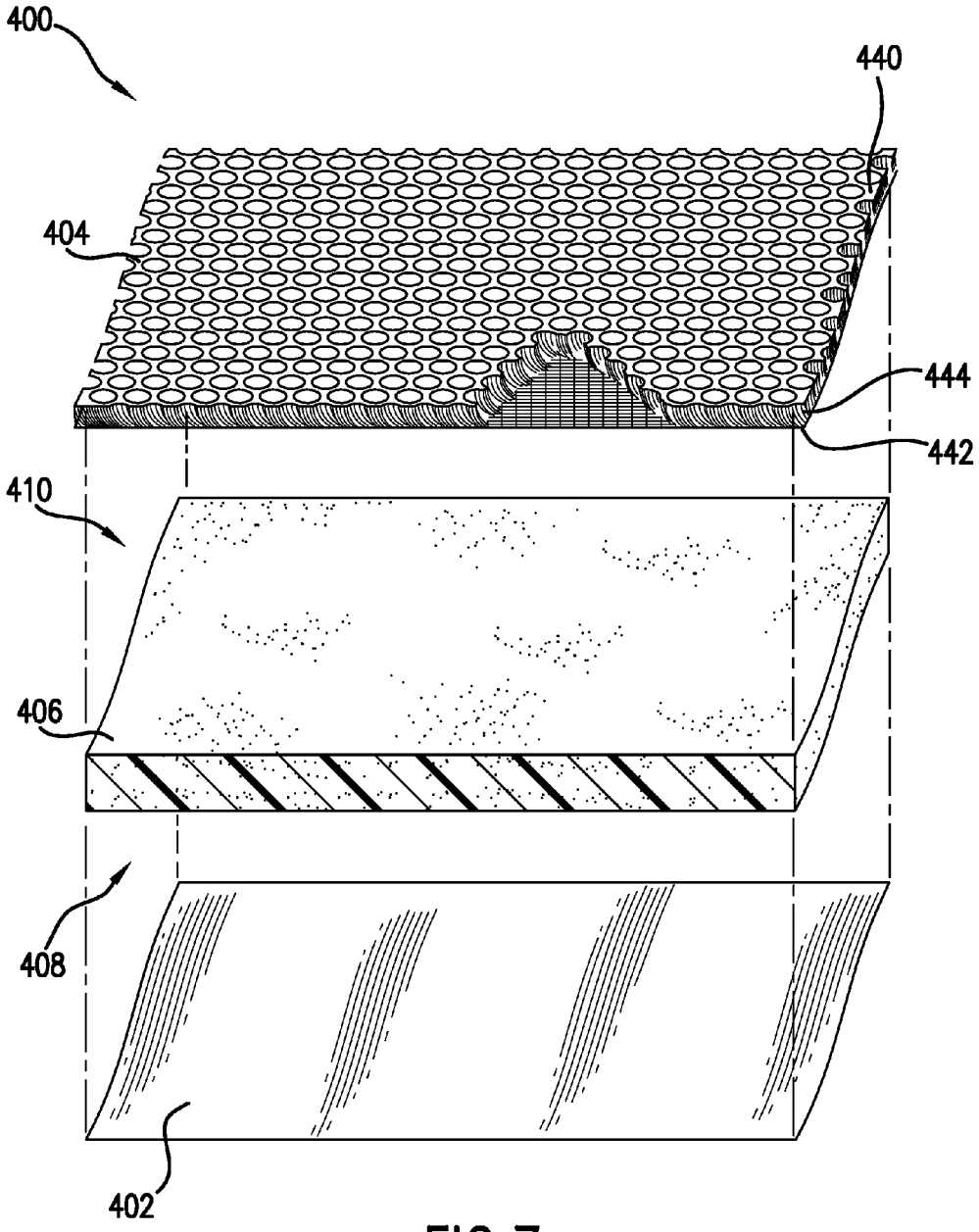
FIG. 7 is an exploded three-dimensional view of a portion of a personal flotation device representing yet another embodiment of the invention.

FIG. 7 is an exploded view of a panel portion 400 representing yet another embodiment of the invention. Thus, the FIG. 1 panels 22, 24 and 28 may be embodied as the FIG. 7 panel portion 400. The FIG. 7 panel portion 400 includes an outer layer 402 corresponding to the FIG. 1 outer layer 40, in the form of a durable, abrasion- and rip-resistant material, such as 200 denier rip stop nylon. The panel portion 400 additionally includes a permeable inner layer 404, corresponding to the permeable inner layer 42 of FIG. 1, in the form of a three-dimensional knit spacer fabric 404 as described in greater detail hereinbelow.

Between the outer layer 402 and the permeable inner layer 404 is a buoyant intermediate layer 406. The buoyant intermediate layer 406 has an outer side 408 facing towards the outer layer 402 and an inner side 410 facing towards the permeable inner layer 404. In FIG. 7, the buoyant intermediate layer 406 is unitary, not including sublayers. However, the buoyant intermediate layer 406 may as well include sublayers.

The permeable inner layer 404 more particularly takes the form of three-dimensional knit spacer fabric 404 of the type including spaced-apart inner 440 and outer 442 permeable fabric sublayers interconnected by resilient pile 444. The resilient pile 444 defines passages for fluid passage at least in directions generally parallel to the inner layer 404 (i.e., "lateral"). Although they have the appearance of being of laminated construction (which they are not), such three-dimensional knit spacer fabrics with sublayers are produced by knitting on specialized knitting machines. General examples of knitted textile spacer fabrics are provided by the disclosures of Spillane et al U.S. Pat. No. 5,385,036 and Rock et al U.S. Pat. No. 5,896,758.

In FIG. 7, the permeable inner layer 404 in the form of three-dimensional knit spacer fabric may range in thickness from 3 mm to 25 mm, as examples. One particular example is Gehring Textile style SHR860/1 wherein the inner fabric sublayer 440 somewhat resembles the large-void polyester mesh employed as the permeable inner layer 42, 104, 204 and 304 as described hereinabove with FIGS. 1, 2, 5 and 6. The aperture size is approximately 2 mm, and the spacing is approximately 2 mm to 4 mm. The outer fabric sublayer 442 in the illustrated embodiment is somewhat different, and takes the form of a square grid where each square is approximately 1 mm. The resilient pile 444, defined during the knitting process, extends between the inner and outer fabric sublayers 440 and 442. Although resilient, the pile 444 has sufficient mechanical strength to maintain spacing between the inner and outer fabric sublayers 442.

In the embodiment of FIG. 7, the buoyant intermediate layer 406 is not permeable. Accordingly, "venting" air flow is primarily in directions generally parallel to the inner layer 404 (i.e., "lateral"). However, the FIG. 7 structure may be modified by providing apertures through the buoyant intermediate layer 406 to allow fluid passage through the buoyant intermediate layer 406 and the outer layer 402.

One such modification is described hereinbelow with reference to FIG. 8, wherein there is a relatively large aperture through the buoyant intermediate layer, as in the case of the FIG. 5 buoyant intermediate layer 206. Another modification is described hereinbelow with reference to FIG. 9, wherein the buoyant intermediate layer is provided with a plurality or multiplicity of apertures, as in the case of the FIG. 6 buoyant intermediate layer 306.

Figure 8:
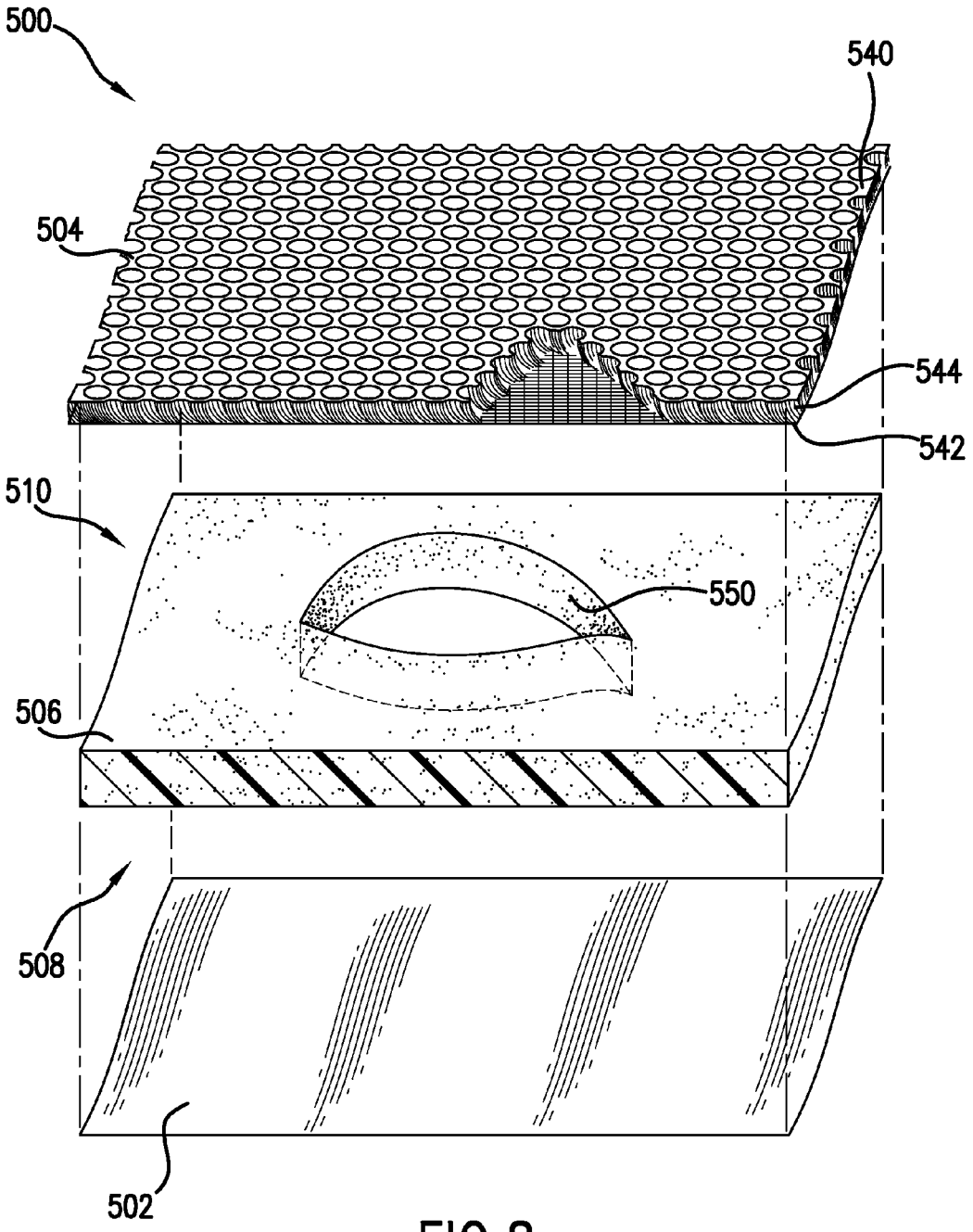
FIG. 8 is an exploded three-dimensional view of a portion of a personal flotation device representing yet another embodiment of the invention.

Thus, FIG. 8 is an exploded view of a panel portion 500 representing yet another embodiment of the invention. The FIG. 1 panels 22, 24 and 28 may be embodied as the FIG. 8 panel portion 500. The panel portion 500 includes a permeable outer layer 502 corresponding to the FIG. 1 outer layer 40, in the form of a durable, abrasion- and rip-resistant material, such as 200 denier rip stop nylon. The outer layer 502 is permeable, in the same manner as is described hereinabove with reference to the permeable outer layer 302 of FIG. 6. The panel portion 500 additionally includes a permeable inner layer 504, corresponding to the permeable inner layer 42 of FIG. 1, in the form of a three-dimensional knit spacer fabric substantially identical to the three-dimensional knit spacer fabric layer 404 described hereinabove with reference to FIG. 7.

Between the outer layer 502 and the permeable inner layer 504 is a buoyant intermediate layer 506. The buoyant intermediate layer 506 has an outer side 508 facing towards the outer layer 502 and an inner side 510 facing towards the permeable inner layer 504. In FIG. 8, the buoyant intermediate layer 506 is unitary, not including sublayers. However, the buoyant intermediate layer 506 may as well include sublayers.

Just as is described hereinabove in the context of the three-dimensional knit spacer fabric permeable inner layer 404 of FIG. 7, the permeable inner layer 504 of FIG. 8 is a three-dimensional knit spacer fabric including spaced-apart inner 540 and outer 542 fabric sublayers interconnected by resilient pile 544.

The panel portion 500 of FIG. 8 differs from the panel portion 400 of FIG. 7 in that an aperture 550 is provided in the buoyant intermediate layer 506, essentially the same as the aperture 220 in the buoyant intermediate layer 206 of FIG. 5. As an alternative to the outer layer 502 being uniformly permeable, the FIG. 8 outer layer 502 may have a discrete mesh cover (not shown) over the aperture 550, like the mesh cover 216 described hereinabove with reference to the FIG. 5 embodiment.

In the FIG. 8 embodiment, at least two modes are provided for fluid passage or "venting," similar to those described hereinabove with reference to FIG. 5.

One fluid passage mode is in directions parallel to the inner side 510, through the permeable inner layer 504 of the three-dimensional knit spacer fabric. The second fluid passage mode is through the aperture 550 in the buoyant intermediate layer 506, and then through the permeable outer layer 502. Depending upon the particular design of the panel portion 500 embodying any one of the FIG. 1 panels 22, 24 and 28, a blend or combination of these two modes is achieved.

Figure 9:
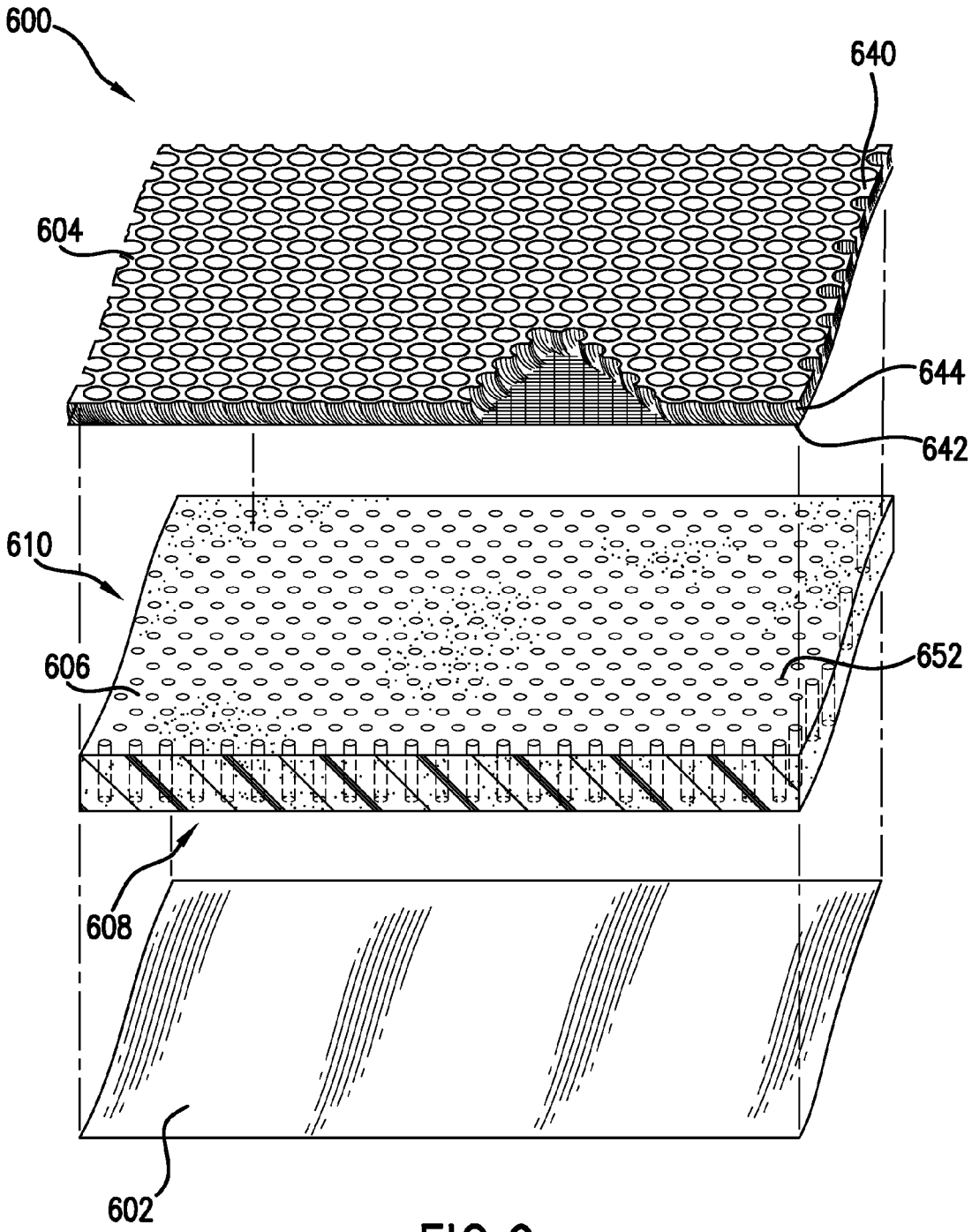
FIG. 9 is an exploded three-dimensional view of a portion of a personal flotation device representing yet another embodiment of the invention.

Likewise, FIG. 9 is an exploded view of a panel portion 600 representing yet another embodiment of the invention. The FIG. 1 panels 22, 24 and 28 may be embodied as the FIG. 9 panel portion 600. The panel portion 600 includes a permeable outer layer 602 corresponding to the FIG. 1 outer layer 40, in the form of a durable, abrasion- and rip-resistant material, such as 200 denier rip stop nylon. The outer layer 602 is permeable, in the same manner as is described hereinabove with reference to the permeable outer layer 302 of FIG. 6. The panel portion 600 additionally includes a permeable inner layer 604, corresponding to the permeable inner layer 42 of FIG. 1, in the form of a three-dimensional knit spacer fabric substantially identical to the three-dimensional knit spacer fabric layer 404 described hereinabove with reference to FIG. 7.

Between the outer layer 602 and the permeable inner layer 604 is a buoyant intermediate layer 606. The buoyant intermediate layer 606 has an outer side 608 facing towards the outer layer 602 and an inner side 610 facing towards the permeable inner layer 604. In FIG. 9, the buoyant intermediate layer 606 is unitary, not including sublayers. However, the buoyant intermediate layer 606 may as well include sublayers.

Just as is described hereinabove in the context of the three-dimensional knit spacer fabric permeable inner layer 404 of FIG. 7, the permeable inner layer 604 of FIG. 9 is a three-dimensional knit spacer fabric including spaced-apart inner 640 and outer 642 fabric sublayers interconnected by resilient pile 644.

The panel portion 600 embodiment of FIG. 9 differs from the panel portion 500 embodiment of FIG. 8 in that, rather than a relatively small number (e.g. four) of relatively large apertures, a relatively larger number of apertures 652, in other words, a multiplicity of apertures 652, are provided in and extending through the buoyant intermediate layer 606. By way of example, the apertures 652 may each have a diameter within the range of 1 mm to 7 mm, with a density of 3 to 20 apertures per square centimeter. Suitable materials for the apertured buoyant intermediate layer 606 include closed-cell foam materials such as polyethylene, NBR, PVC, neoprene, and EVA.

In FIG. 9, the outer layer 602 is permeable at least where the apertures 652 terminate. As a practical matter, the outer layer 602 is uniformly permeable. An example of a suitable material is uncoated 240 denier nylon.

In the FIG. 9 embodiment, at least two modes are provided for fluid passage or "venting," similar to those described hereinabove with reference to FIG. 5.

One fluid passage mode is in directions parallel to the inner side 610, through the permeable inner layer 604 of the three-dimensional knit spacer fabric. The second fluid passage mode is through the apertures 652 in the buoyant intermediate layer 606, and then through the permeable outer layer 602. Depending upon the particular design of the panel portion 600 embodying any one of the FIG. 1 panels 22, 24 and 28, a blend or combination of these two modes is achieved.

Figure 10:
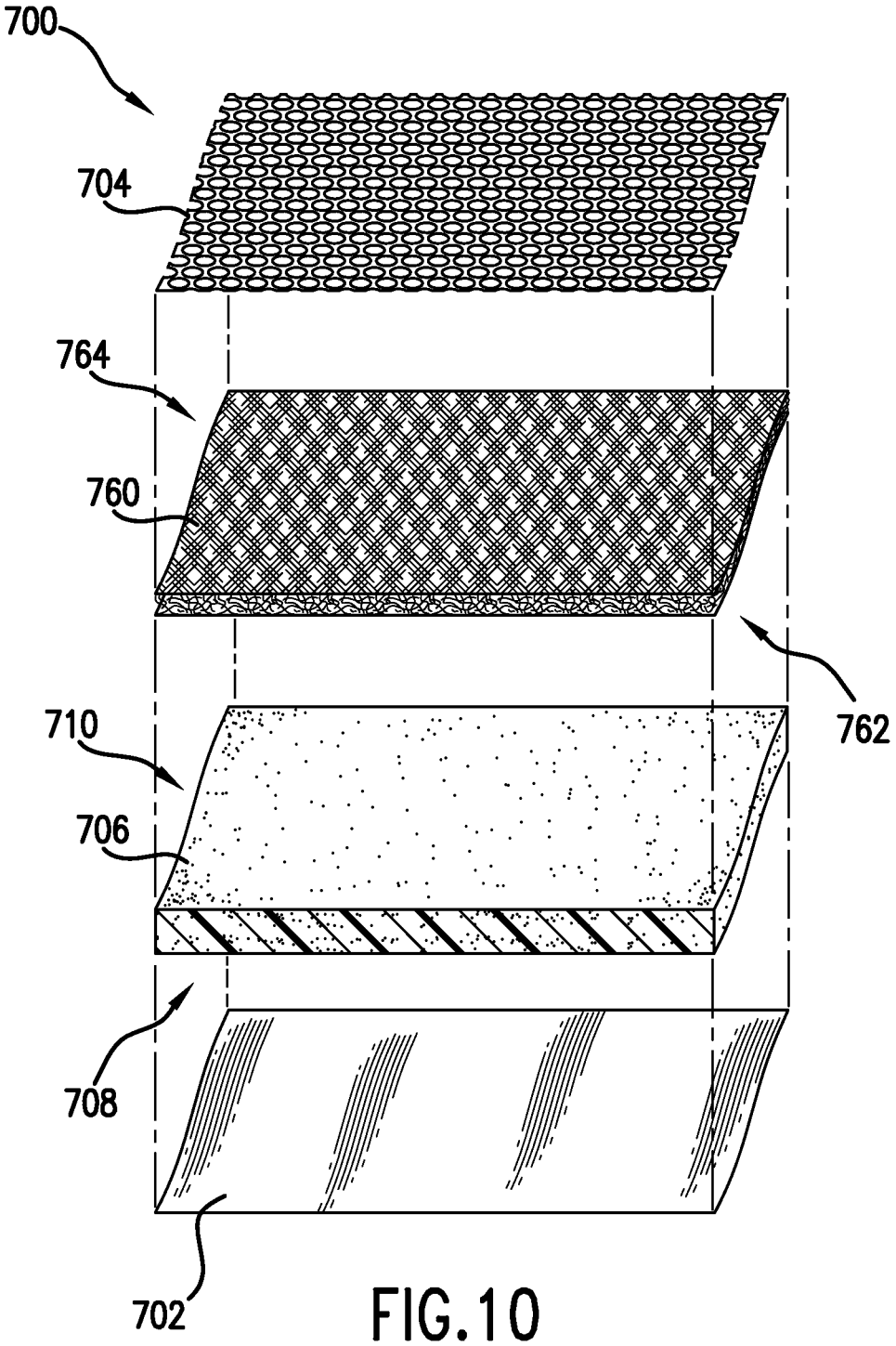
FIG. 10 is an exploded three-dimensional view of a portion of a personal flotation device representing yet another embodiment of the invention.

FIG. 10 is an exploded view of a panel portion 700 representing yet another embodiment of the invention. Thus, the FIG. 1 panels 22, 24 and 28 may be embodied as the FIG. 10 panel portion 700. The panel portion 700 includes an outer layer 702 corresponding to the FIG. 1 outer layer 40, in the form of a durable, abrasion- and rip-resistant material, such as 200 denier rip stop nylon. The panel portion 700 additionally includes a permeable inner layer 704, corresponding to the permeable inner layer 42 of FIG. 1, and taking the form of plastic mesh such as large-void polyester mesh.

Within the panel portion 700, adjacent the outer layer 702, is a buoyant intermediate layer 706. The buoyant intermediate layer 706 has an outer side 708 facing towards the outer layer 702, as well as an inner side 710. In FIG. 10, the buoyant intermediate layer 706 is unitary, not including sublayers. However, the buoyant intermediate layer 706 may as well include sublayers.

Also within the FIG. 10 panel portion 700, adjacent the permeable inner layer 704, is a permeable intermediate layer 760 made of a permeable three-dimensional material. The permeable intermediate layer 760 has an outer side 762 facing towards the inner side 710 of the buoyant intermediate layer 706, as well as an inner side 764 facing towards the permeable inner layer 704.

In FIG. 10, the permeable intermediate layer 760 is representative of any one of a variety of three-dimensional materials sufficiently permeable and of sufficient thickness to allow for fluid passage at least in directions generally parallel to the permeable intermediate layer 760 and parallel to the permeable inner layer 704, which also may be referred to as "lateral" air flow. One example is a three-dimensional knit spacer fabric including spaced-apart fabric sublayers interconnected by resilient pile, like the spacer fabric 404 described hereinabove in the context of FIG. 7. Another example of a suitable material for the permeable intermediate layer 760 is a woven three-dimensional fabric, similar to the three-dimensional knit spacer fabric 404, but without necessarily including the inner fabric sublayer 440 and the outer fabric sublayer 442. Such materials are generally known as "spacer fabric", and are commercially available in a wide variety of specific styles, for a wide variety of applications in various thicknesses, such as shoe linings, cushioning for chairs, and mattresses. A general example of a woven three-dimensional fabric is provided by Sato et al U.S. Pat. No. 4,787,219.

As another example, the permeable intermediate layer 760 may be made of a non-woven three-dimensional fabric. More particular examples are spunbond and meltblown sheet materials.

In the embodiment of FIG. 10, the buoyant intermediate layer 706 is not permeable. Accordingly, "venting" air flow is primarily in directions parallel to the permeable inner layer 704 (i.e., "lateral"), through the permeable intermediate layer 760. However, the FIG. 10 structure may be modified by providing apertures through the buoyant intermediate layer 706 to allow fluid passage through the buoyant intermediate layer 706 and the outer layer 702.

Figure 11:
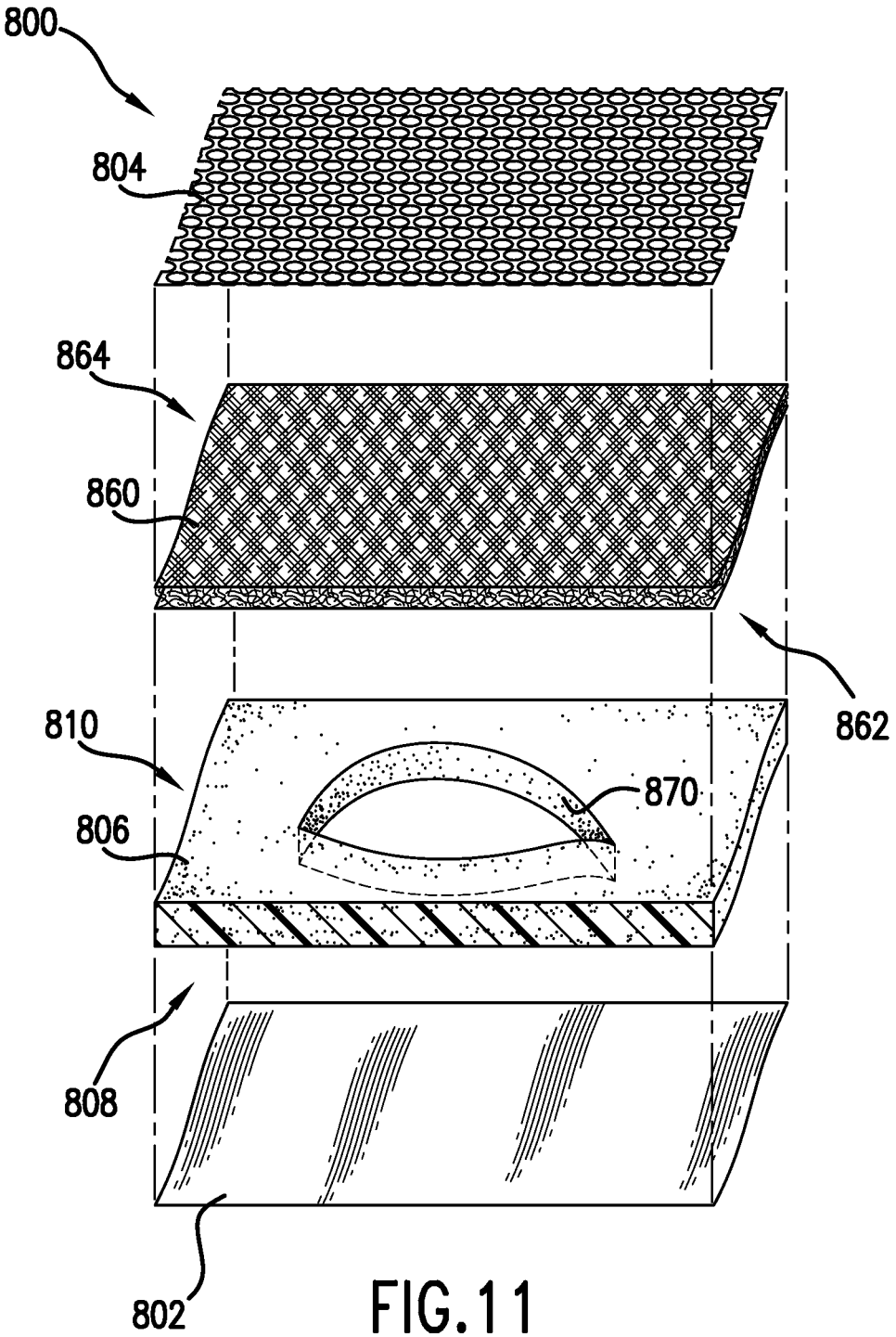
FIG. 11 is an exploded three-dimensional view of a portion of a personal flotation device representing yet another embodiment of the invention.

FIG. 11 illustrates one such modification. More particularly, FIG. 11 is an exploded view of a panel portion 800 representing yet another embodiment of the invention. Thus, the FIG. 1 panels 22, 24 and 28 may be embodied as the FIG. 11 panel portion 800. The panel portion 800 includes an outer layer 802 corresponding to the FIG. 1 outer layer 40, in the form of a durable, abrasion- and rip-resistant material, such as 200 denier rip stop nylon. The panel portion 800 additionally includes a permeable inner layer 804, corresponding to the permeable inner layer 42 of FIG. 1, and taking the form of plastic mesh such as large-void polyester mesh.

Within the panel portion 800, adjacent the outer layer 802, is a buoyant intermediate layer 806. The buoyant intermediate layer 806 has an outer side 808 facing towards the outer layer 802, as well as an inner side 810. In FIG. 11, the buoyant intermediate layer 806 is unitary, not including sublayers. However, the buoyant intermediate layer 806 may as well include sublayers.

Also within the FIG. 11 panel portion 800, adjacent the permeable inner layer 804, is a permeable intermediate layer 860. The permeable intermediate layer 860 is made of a permeable three-dimensional material, the same as the permeable three-dimensional material 760 described above with reference to FIG. 10. The permeable intermediate layer 860 has an outer side 862 as well as a inner side 864.

The panel portion 800 of FIG. 11 differs from the panel portion 700 of FIG. 10 in that an aperture 870 is provided in the buoyant intermediate layer 806, essentially the same as the aperture 220 in the buoyant intermediate layer 206 of FIG. 5, and the aperture 550 in the buoyant intermediate layer 506 of FIG. 8. As an alternative (not shown), a multiplicity of apertures like the apertures 330 described hereinabove with reference to FIG. 6 and like the apertures 652 described hereinabove with reference to FIG. 9 may be provided in the buoyant intermediate layer 806. The outer layer 806 may be uniformly permeable as illustrated in FIG. 11, or may have a discrete mesh cover (not shown) over the aperture 870, like the mesh cover 226 described hereinabove with reference to the FIG. 5 embodiment.

Accordingly, in the FIG. 11 embodiment, at least two modes are provided for fluid passage or "venting," similar to those described hereinabove with reference to FIG. 5. One fluid passage mode is in directions parallel to the inner side 810, through the permeable intermediate layer 860. The second fluid passage mode is through the aperture 870 in the buoyant intermediate layer 806, and then through the permeable outer layer 802. Depending upon the particular design of the panel portion 800 embodying any one of the FIG. 1 panels 22, 24 and 28, a blend or combination of these two modes is achieved.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A personal flotation vest, comprising:

at least one front panel configured to fit on the front of the torso of a person;

at least one rear panel configured to fit on the rear of the torso of the person and being connected to the front panel;

vest shoulders connected to a top of the front panel and a top of the rear panel and being configured to extend over each of the shoulders of the person to support the front and rear panels on the person;

the front panel, the rear panel and the vest shoulders being configured to expose and not restrain the arms of the person when the vest is worn, the front panel including:

a front outer layer constructed of a fabric that is permeable to air and moisture;

a front inner layer constructed of a fabric that is permeable to air and moisture;

a front buoyant intermediate layer of buoyant closed cell foam material having an inner side and an outer side and being disposed between the front outer layer and the front inner layer; and at least one front aperture extending through a mid-region of the front buoyant intermediate layer, and being oriented and configured to allow air and moisture passage in a horizontal direction through said front aperture, the horizontal direction being defined as generally perpendicular to the front outer layer, the front inner layer, and the front buoyant intermediate layer;

ventilation passageways for ventilating the torso disposed adjacent to the inner side of the front buoyant intermediate layer, the ventilation passageways communicating with the front aperture, extending away from the front aperture and extending along and adjacent to the inner side of the front buoyant intermediate layer in directions that are up, down, left and right with respect to the front aperture;

the rear panel including;

a rear outer layer;

a rear inner layer; and a rear buoyant intermediate layer of buoyant closed cell foam material held between the rear outer layer and the rear permeable inner.

2. The personal flotation vest of claim 1, wherein said front buoyant intermediate layer further comprises a plurality of projections on said inner side of said buoyant intermediate layer serving as spacers from said front permeable inner layer so as to define said passageways communicating with said aperture.

3. The personal flotation vest of claim 2 wherein the projections are convoluted closed cell foam projections configured to form passageways around each projection, the passageway around each projection being in fluid communication with passageways around adjacent passageways.

4. The personal flotation vest of claim 1, wherein said front permeable inner layer comprises a three-dimensional knit spacer fabric including spaced-apart inner and outer permeable fabric sublayers interconnected by resilient pile, said resilient pile defining said passageways communicating with said aperture.

5. The personal flotation vest of claim 1, wherein said front buoyant intermediate layer has an inner side facing towards said front inner layer and which further comprises a plurality of projections on said inner side of said buoyant intermediate layer serving as spacers from said front permeable inner layer so as to define passages that extend from the aperture to a side of the front panel.

6. The personal flotation vest of claim 5 wherein said projections are unitary with said front buoyant intermediate layer and form passageways around each projection, the passageway around each projection being in fluid communication with passageways around adjacent passageways.

7. The personal flotation vest of claim 1 wherein the front aperture and inner and outer layers are configured to provide air and liquid flow through the front aperture.

8. The personal flotation device of claim 1 wherein the rear panel includes at least one rear aperture extending through said rear buoyant intermediate layer oriented to allow fluid passage in a horizontal direction through said rear aperture, the horizontal direction being defined as generally perpendicular to the torso when the personal flotation vest is worn and being generally perpendicular to the rear outer layer, the rear inner layer, and the rear buoyant intermediate layer adjacent the aperture.

9. The personal flotation vest of claim 1 further comprising a plurality of apertures through the front buoyant intermediate layer and the rear buoyant intermediate layer for venting air and moisture to and from the torso of the person, each aperture being oriented to allow fluid passage in a horizontal direction through said aperture, the horizontal direction being defined individually for each aperture as being generally perpendicular to the outer layer, the inner layer, and the buoyant intermediate layer adjacent the aperture in the front or rear panels.

* * * * *